US010550832B2

(12) United States Patent
Itahara et al.

(10) Patent No.: US 10,550,832 B2
(45) Date of Patent: Feb. 4, 2020

(54) DIAPHRAGM PUMP

(71) Applicant: OKENSEIKO Co., Ltd., Tokyo (JP)

(72) Inventors: Kazuki Itahara, Tokyo (JP); Fumitaka Takamizawa, Tokyo (JP)

(73) Assignee: OKENSEIKO Co., Ltd., Tokyo (JP)

( * ) Notice: Subject to any disclaimer, the term of this patent is extended or adjusted under 35 U.S.C. 154(b) by 177 days.

(21) Appl. No.: 15/887,926

(22) Filed: Feb. 2, 2018

(65) Prior Publication Data

US 2018/0223828 A1 Aug. 9, 2018

(30) Foreign Application Priority Data

Feb. 3, 2017 (JP) ..... 2017-018443

(51) Int. Cl.
*F04B 43/00* (2006.01)
*F04B 45/04* (2006.01)
(Continued)

(52) U.S. Cl.
CPC ..... *F04B 43/0045* (2013.01); *F04B 43/0063* (2013.01); *F04B 43/02* (2013.01);
(Continued)

(58) Field of Classification Search
CPC ..... F04B 43/02; F04B 43/04; F04B 43/026; F04B 43/0045; F04B 43/0063;
(Continued)

(56) References Cited

U.S. PATENT DOCUMENTS 4,801,249 A * 1/1989 Kakizawa ..... A61B 5/0235 417/269
4,865,525 A * 9/1989 Kern ..... F04B 23/06 417/307
(Continued)

FOREIGN PATENT DOCUMENTS

CN 101310109 A 11/2008
CN 102213210 A 10/2011
(Continued)

OTHER PUBLICATIONS

Office Action received for Chinese Patent Application No. 201810101787.9, dated Jan. 4, 2019, 15 pages (8 pages of English Translation and 7 pages of Office Action).
(Continued)

*Primary Examiner* — Peter J Bertheaud
(74) *Attorney, Agent, or Firm* — Womble Bond Dickinson (US) LLP

(57) ABSTRACT

A diaphragm pump includes a driving mechanism and a counting sensor. The driving mechanism includes an arm portion attached to a deformed portion that forms a pump chamber, and a crank that rotates integrally with the rotating shaft of a motor, in which the rotation of the crank is converted into a reciprocal motion to make the arm portion reciprocally move. The counting sensor is configured to use the arm portion as a detection target and alternately switch between a detection state and a non-detection state as the arm portion makes the reciprocal motion. It is therefore possible to provide a diaphragm pump capable of detecting
(Continued)

a discharge flow rate using an inexpensive ready-made motor.

8 Claims, 2 Drawing Sheets

(51) Int. Cl.
*F04B 43/02* (2006.01)
*F04B 45/047* (2006.01)
*F04B 43/04* (2006.01)

(52) U.S. Cl.
CPC ..... *F04B 43/026* (2013.01); *F04B 43/04* (2013.01); *F04B 45/04* (2013.01); *F04B 45/043* (2013.01); *F04B 45/047* (2013.01); *F04B 2201/0201* (2013.01)

(58) Field of Classification Search
CPC ..... F04B 45/04; F04B 45/043; F04B 45/047; F04B 2201/0201
See application file for complete search history.

(56) References Cited

U.S. PATENT DOCUMENTS

| | | | | |
|---|---|---|---|---|
| 4,913,624 | A * | 4/1990 | Seki | F04B 11/00 417/15 |
| 6,371,740 | B1 * | 4/2002 | Jansen | F04B 11/0066 417/413.1 |
| 10,143,339 | B2 * | 12/2018 | Ciavarella | A47K 5/16 |
| 10,253,768 | B2 * | 4/2019 | Yan | F04B 43/021 |
| 10,385,834 | B2 * | 8/2019 | Chang | |
| 2007/0041845 | A1 * | 2/2007 | Freudenberger | F04B 13/00 417/63 |
| 2009/0047137 | A1 | 2/2009 | Stenberg | |
| 2013/0034452 | A1 | 2/2013 | Itahara | |
| 2018/0023556 | A1 * | 1/2018 | Yan | F04B 9/045 417/42 |
| 2018/0320681 | A1 * | 11/2018 | Chang | F04B 43/043 |
| 2018/0320683 | A1 * | 11/2018 | Chang | F04B 49/20 |

FOREIGN PATENT DOCUMENTS

| | | | |
|---|---|---|---|
| CN | 102913424 | A | 2/2013 |
| EP | 0199512 | A2 | 10/1986 |
| EP | 1939449 | A2 | 7/2008 |
| EP | 3358185 | A1 | 8/2018 |
| IE | 202005013090 | U1 | 1/2007 |
| JP | 2013-036350 | A | 2/2013 |
| WO | 2009/134181 | A1 | 11/2009 |
| WO | 2013/013725 | A1 | 1/2013 |

OTHER PUBLICATIONS

European Search Report and Written Opinion received for EP Patent Application No. 18154595.5, dated Jul. 3, 2018, 7 pages.

* cited by examiner

DIAPHRAGM PUMP

BACKGROUND OF THE INVENTION

The present invention relates to a diaphragm pump including a driving mechanism that converts the rotation of a motor into a reciprocal motion and drives the deformed portion of a diaphragm.

A related diaphragm pump is disclosed in, for example, Japanese Patent Laid-Open No. 2013-36350 (literature 1). The diaphragm pump disclosed in literature 1 is integrated with a motor, and includes a pump mechanism including a diaphragm, a driving mechanism that converts the rotation of the motor into a reciprocal motion and drives the pump mechanism, and the like.

The diaphragm includes a cup-shaped deformed portion. The opening portion of the deformed portion is closed by the pump main body. A pump chamber is formed between the deformed portion and the pump main body.

The pump mechanism includes an inlet valve and a discharge valve and employs an arrangement in which when the capacity of the pump chamber increases, a fluid is sucked into the pump chamber, and when the capacity of the pump chamber decreases, the fluid in the pump chamber is discharged.

The driving mechanism includes a reciprocal motion portion attached to the deformed portion of the diaphragm, and an input portion that rotates integrally with the rotating shaft of the motor, and employs an arrangement in which the rotation of the input portion is converted into a reciprocal motion, and the reciprocal motion portion reciprocally moves.

In the diaphragm pump of this type, detection of the flow rate of the discharged fluid is indirectly performed using the rotation speed of the motor. That is, when the rotating shaft of the motor makes one rotation, the reciprocal motion portion of the driving mechanism makes one reciprocal motion, and the fluid is discharged as much as the capacity of the pump chamber. It is therefore possible to detect the discharge flow rate based on the rotation speed of the motor. As a method of detecting the rotation speed of the motor for the diaphragm pump, the following three methods are mainly used.

As the first method, a brushless motor is used as a motor, and a rotation speed is detected using a Hall device provided on a motor control board. When this method is employed, a ready-made brushless motor can be used.

As the second method, a brushed motor is used as a motor, and the motor is equipped with a device configured to detect a rotation speed, or the rotation speed is detected from the current waveform of the motor. To employ this method, a function of detecting the rotation speed needs to be imparted to the motor. Hence, a custom-designed motor is used.

As the third method, a brushed motor is used as a motor, an impeller is provided on the motor on the opposite side of the pump so as to rotate integrally with the motor, and the rotation of the impeller is detected by a sensor. In a case in which this method is employed as well, a custom-designed motor is used.

Hence, to enable detection of the discharge flow rate in the related diaphragm pump, a brushless motor or a custom-designed brushed motor having the function of detecting the rotation speed is necessary. The brushless motor or custom-designed brushed motor is more expensive than a ready-made brushed motor. For this reason, a diaphragm pump capable of detecting the discharge flow rate using an inexpensive ready-made motor is required.

SUMMARY OF THE INVENTION

The present invention has been made to meet this requirement, and has as its object to provide a diaphragm pump capable of detecting a discharge flow rate using an inexpensive ready-made motor.

In order to achieve the above object, according to the present invention, there is provided a diaphragm pump comprising a diaphragm including a deformed portion capable of being deformed into a cup shape, a pump main body configured to close an opening portion of the deformed portion and form a pump chamber in cooperation with the deformed portion, a driving mechanism including a reciprocal motion portion attached to the deformed portion and an input portion that rotates integrally with a rotating shaft of a motor, in which a rotation of the input portion is converted into a reciprocal motion in an axial direction of the rotating shaft, and the reciprocal motion portion reciprocally moves, a pump mechanism configured to suck a fluid into the pump chamber when a capacity of the pump chamber increases, and discharges the fluid in the pump chamber when the capacity of the pump chamber decreases, and a sensor configured to use the reciprocal motion portion as a detection target and alternately switch between a detection state and a non-detection state as the reciprocal motion portion makes a reciprocal motion.

DESCRIPTION OF THE PREFERRED EMBODIMENT

A diaphragm pump according to an embodiment of the present invention will now be described in detail with reference to FIGS. 1 and 2.

Figure 1:
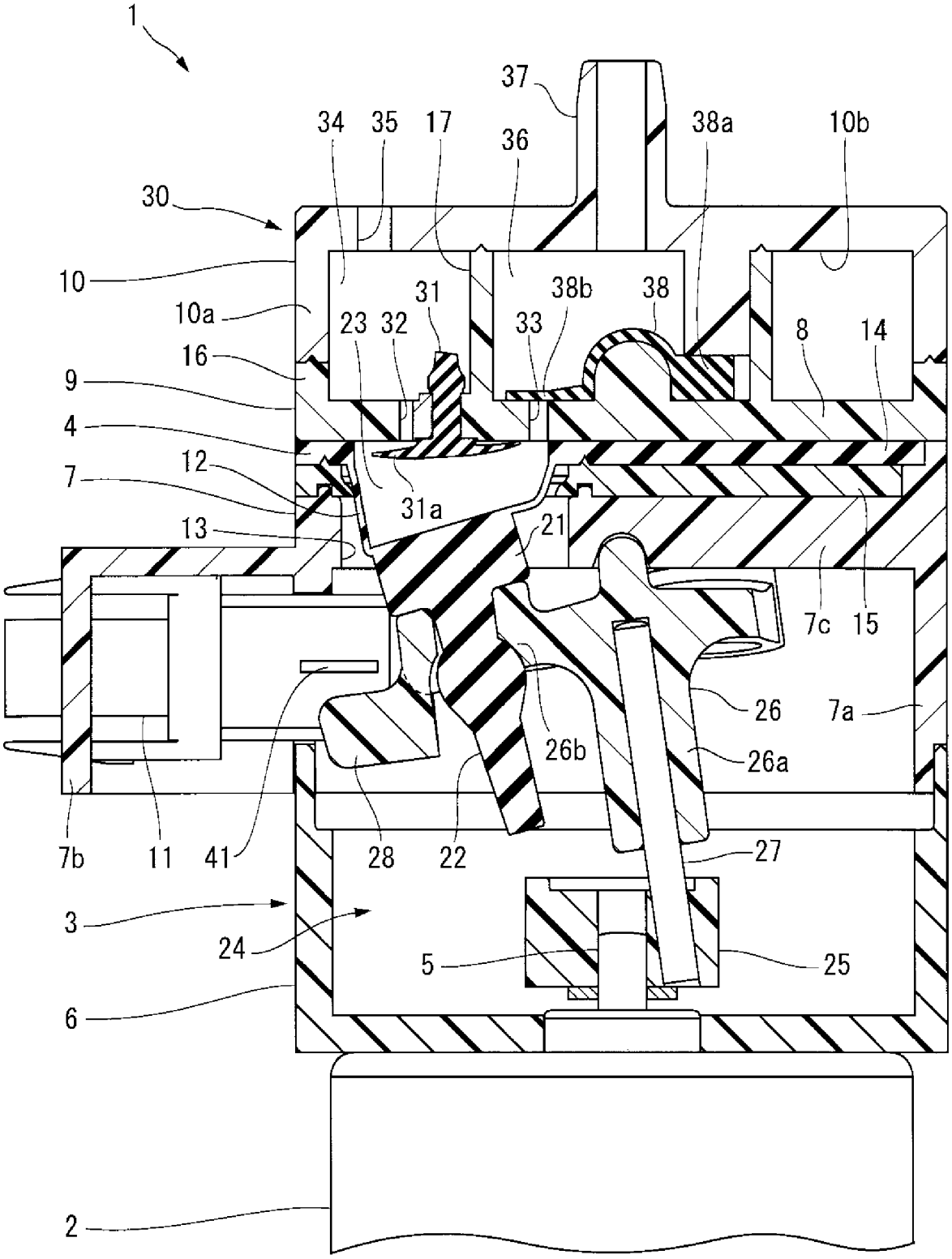
FIG. 1 is a sectional view of a diaphragm pump according to an embodiment of the present invention, which shows a state in which a sensor does not detect a reciprocal motion portion.

A diaphragm pump 1 shown in FIG. 1 is a pump attached to a motor 2 located at the lowermost position in FIG. 1 and driven by the motor 2 to suck and discharge air. The motor 2 does not have a function of detecting the rotation speed of the diaphragm pump 1. As the motor 2, for example, a ready-made brushed motor can be used.

The diaphragm pump 1 includes a housing 3 attached to the motor 2 and a diaphragm 4 held by the housing 3.

The housing 3 is formed into a columnar shape by combining a plurality of members to be described later in the axial direction of the motor 2, and located on the same axis as a rotating shaft 5 of the motor 2. The plurality of members constructing the housing 3 include a bottom body 6 having a cylindrical shape with a closed bottom, which is attached to the motor 2, a diaphragm holder 7 with one end attached to the opening portion of the bottom body 6, a valve holder 9 having a cylindrical shape with a closed bottom, which includes a bottom wall 8 overlaid on the other end of the diaphragm holder 7, a lid body 10 that closes the opening portion of the valve holder 9, and the like. These members are fastened by a fastening structure (not shown) in a state in which they are combined in the axial direction of the rotating shaft 5.

The diaphragm holder 7 includes three members. The first member is a tubular portion 7*a* having a cylindrical shape with one end connected to the opening portion of the bottom body 6. The second member is a sensor holder portion 7*b* projecting outward in the radial direction from the tubular portion 7*a*. A counting sensor 11 to be described later is attached to the sensor holder portion 7*b*. The third member is a plate-shaped portion 7*c* that closes the other end of the tubular portion 7*a*. A through hole 13 that receives a deformed portion 12 of the diaphragm 4 to be described later is formed in the plate-shaped portion 7*c*. In addition, a support plate 15 that supports a base 14 of the diaphragm 4 is provided on the plate-shaped portion 7*c*.

The valve holder 9 includes the disc-shaped bottom wall 8, an outer tube 16 projecting from the outer peripheral portion of the bottom wall 8 to the opposite side of the diaphragm holder 7, and an inner tube 17 projecting from the central portion of the bottom wall 8 to the opposite side of the diaphragm holder 7. The distal end of the outer tube 16 is connected to a cylindrical portion 10*a* of the lid body 10. The distal end of the inner tube 17 is connected to an inner bottom surface 10*b* of the lid body 10. The bottom wall 8 of the valve holder 9 clamps and holds the base 14 of the diaphragm 4 in cooperation with the diaphragm holder 7. The bottom wall 8 corresponds to "pump main body" in the present invention.

The diaphragm 4 is formed from the disc-shaped base 14, the deformed portion 12 projecting from the base 14 to the opposite side of the valve holder 9 and capable of being deformed into a cup shape, and a connecting piece 22 with a piston 21 located on the bottom of the deformed portion 12. In this embodiment, three sets of deformed portions 12, pistons 21, and connecting pieces 22 are provided, although not illustrated, and the three sets are arranged at positions to divide the base 14 of the diaphragm 4 into three equal parts in the circumferential direction. The opening portions of the deformed portions 12 are closed by the bottom wall 8 of the valve holder 9. A pump chamber 23 is formed between the bottom wall 8 and the deformed portion 12. The connecting piece 22 of the diaphragm 4 is connected to a driving mechanism 24.

The driving mechanism 24 includes a crank 25 that is attached to the rotating shaft 5 of the motor 2 and rotates integrally with the rotating shaft 5, and a driving element 26 attached to the crank 25. The driving element 26 includes a columnar shaft portion 26*a* rotatably supported by the crank 25 via a support shaft 27, and a plurality of arm portions 26*b* projecting outward in the radial direction from the shaft portion 26*a* (only one arm portion 26*b* is shown in FIG. 1). The support shaft 27 is connected to a portion of the crank 25 eccentric from the rotating shaft 5, and tilts with respect to the rotating shaft 5. The tilting direction of the support shaft 27 is the direction in which the distal end of the support shaft 27 is located on the same axis as the rotating shaft 5.

The connecting piece 22 of the diaphragm 4 extends through the arm portion 26*b*, and the deformed portion 12 is connected to the arm portion 26*b* via the connecting piece 22. For this reason, the rotation of the driving element 26 is regulated by the diaphragm 4. When the crank 25 rotates together with the rotating shaft 5, the rotation is converted into a reciprocal motion in the axial direction of the rotating shaft 5, and the arm portion 26*b* reciprocally moves. When the arm portion 26*b* makes a reciprocal motion, the capacity (the capacity of the pump chamber 23) in the deformed portion 12 attached to the arm portion 26*b* increases/decreases. The crank 25 corresponds to "input portion" in the present invention, the shaft portion 26*a* of the driving element 26 corresponds to "base" in the present invention, and the arm portion 26*b* of the driving element 26 corresponds to "reciprocal motion portion" and "arm" in the present invention.

The number of arm portions 26*b* equals the number of deformed portions 12. That is, in this embodiment, three arm portions 26*b* are provided. A light-shielding plate 28 is formed integrally with the arm portion 26*b* adjacent to the sensor holder portion 7*b* in the arm portions 26*b*. The light-shielding plate 28 projects from the arm portion 26*b* in the direction opposite to the shaft portion 26*a* and is formed into a plate shape extending in the projecting direction and in the axial direction of the rotating shaft 5.

An inlet valve 31 is provided in a portion of the bottom wall 8 of the valve holder 9, which forms the wall of the pump chamber 23. In addition, a suction through hole 32 and a discharge through hole 33 are formed in that portion. The inlet valve 31 is made of a rubber material and includes a valve body 31*a* that is in tight contact with the wall surface of the bottom wall 8 on the side of the pump chamber 23. The valve body 31*a* opens/closes the opening portion of the suction through hole 32.

The suction through hole 32 communicates with the air via an intake chamber 34 formed between the valve holder 9 and the lid body 10 and an air inlet 35 of the lid body 10. The intake chamber 34 is formed between the outer tube 16 and the inner tube 17 of the valve holder 9. When the capacity of the pump chamber 23 increases, the air (fluid) is sucked into the pump chamber 23 via the air inlet 35, the intake chamber 34, and the suction through hole 32.

The discharge through hole 33 makes the pump chamber 23 and a discharge chamber 36 communicate. The discharge chamber 36 is formed by being surrounded by the inner tube 17 of the valve holder 9 and the lid body 10, and communicates with the air via a discharge pipe 37 projecting from the lid body 10. When the capacity of the pump chamber 23 decreases, the air (fluid) in the pump chamber 23 is discharged via the discharge through hole 33, the discharge chamber 36, and the discharge pipe 37.

A discharge valve 38 is provided at the center of the bottom wall 8 of the valve holder 9 in the discharge chamber 36. The discharge valve 38 is made of a rubber material, and includes a plate-shaped portion 38*a* made of a rubber material and fixed to the bottom wall 8, and a valve body portion 38*b* that opens/closes the discharge through hole 33. Only one plate-shaped portion 38*a* and only one valve body portion 38*b* are illustrated in FIG. 1. In fact, they are provided as many as the deformed portions 12 of the diaphragm 4, and are arranged at a predetermined interval in the circumferential direction of the bottom wall 8.

A pump mechanism 30 is constituted by the discharge valve 38 and the inlet valve 31, the suction through hole 32 and the discharge through hole 33, the intake chamber 34 and the discharge chamber 36, the air inlet 35 and the discharge pipe 37 of the lid body 10, and the like. When the capacity of the pump chamber 23 increases, the pump mechanism 30 sucks the air (fluid) into the pump chamber 23, and when the capacity of the pump chamber 23 decreases, the pump mechanism 30 discharges the air (fluid) in the pump chamber 23.

The counting sensor 11 is configured to detect the operation count of the diaphragm pump 1, that is, the number of reciprocal motions of the piston 21 of the diaphragm 4, and employs an arrangement that sends a detection signal including the information of the count to a control device (not shown). The control device obtains, by calculation, the flow rate of the air discharged from the diaphragm pump 1 based on the number of reciprocal motions of one piston 21.

The counting sensor 11 according to this embodiment is configured to use the arm portion 26*b* of the driving element 26, in particular, the light-shielding plate 28 of the arm portion 26*b* as a detection target, and alternately switches between a detection state and a non-detection state as the arm portion 26*b* of the driving element 26 makes a reciprocal motion. The counting sensor 11 is formed using a photointerrupter 41 serving as an optical sensor.

The photointerrupter 41 includes a light emitting portion and a light receiving portion, which face each other. The light emitting portion and the light receiving portion are arranged such that the direction in which the light emitting portion emits light becomes a direction orthogonal to the sheet surfaces of FIGS. 1 and 2, that is, a direction orthogonal to the above-described light-shielding plate 28. The light emitting portion and the light receiving portion are arranged at positions overlapping the light-shielding plate 28 when the arm portion 26*b* of the driving element 26 reaches one end of a reciprocal motion, that is, the top dead center or the bottom dead center. The optical path of the light emitted by the light emitting portion is interrupted by the light-shielding plate 28 in accordance with the reciprocating operation of the arm portion 26*b* of the driving element 26, as shown in FIG. 2. For this reason, the photointerrupter 41 detects the state shown in FIG. 2, that is, a state in which the capacity of the pump chamber 23 shown in FIG. 2 becomes small, and the optical path is interrupted by the light-shielding plate 28 and the state shown in FIG. 1, that is, a state in which the capacity of the pump chamber 23 becomes large, and the interruption of the optical path is canceled. The light-shielding plate 28 corresponds to "light-shielding portion" and "plate-shaped member" in the present invention.

In the thus configured diaphragm pump 1, when the motor 2 rotates, and the support shaft 27 of the driving element 26 rotates about the rotating shaft 5 of the motor 2, the arm portion 26*b* of the driving element 26 reciprocally moves in the axial direction of the rotating shaft 5, and the deformed portion 12 of the diaphragm 4 is pushed or pulled. When the deformed portion 12 is pulled by the arm portion 26*b* to the side of the motor 2, the capacity of the pump chamber 23 increases, the inlet valve 31 opens, as shown in FIG. 1, and the air in the intake chamber 34 is sucked into the pump chamber 23 via the suction through hole 32. At this time, the air is sucked into the intake chamber 34 via the air inlet 35 of the lid body 10.

Figure 2:
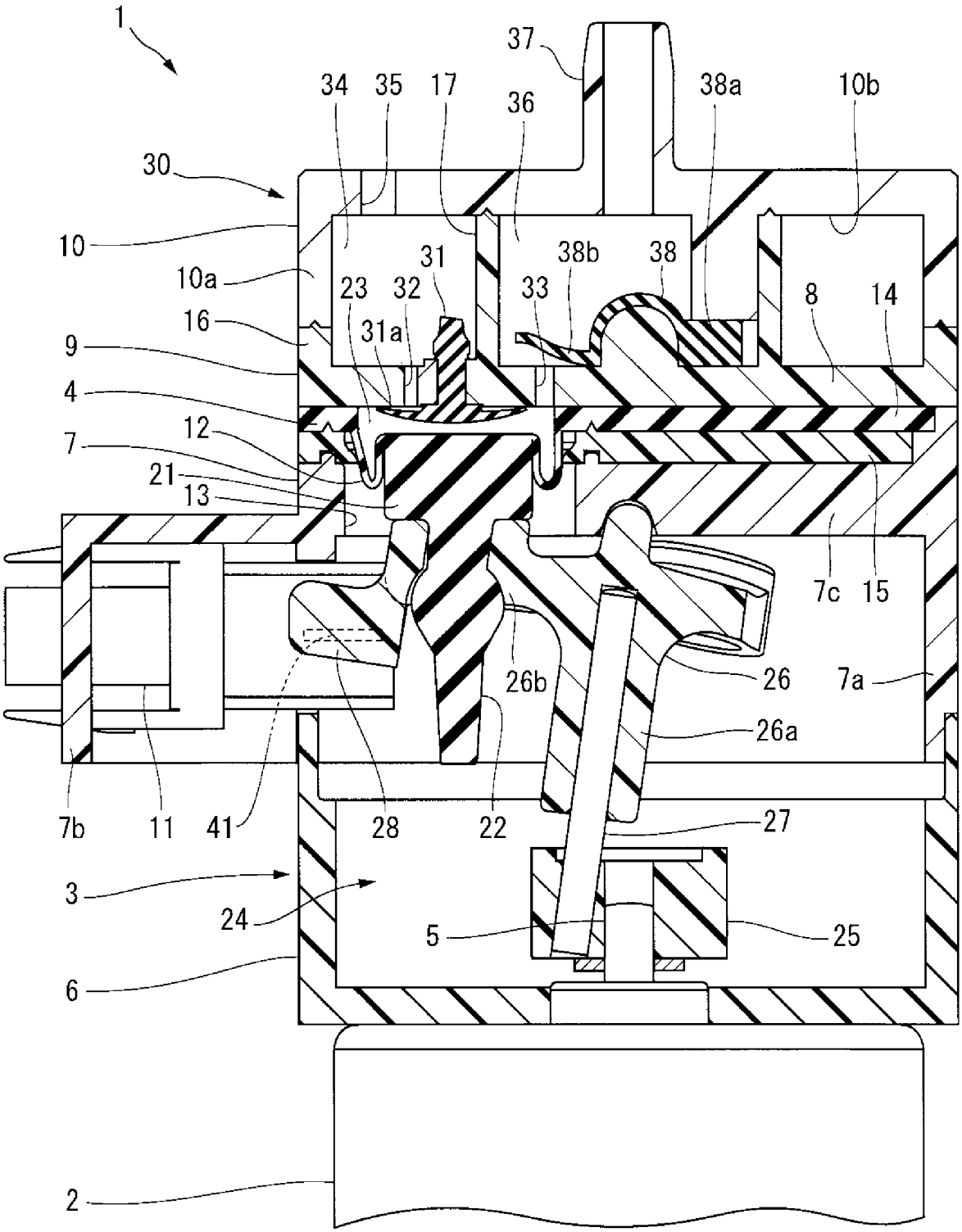
FIG. 2 is a sectional view of the diaphragm pump according to an embodiment of the present invention, which shows a state in which the sensor detects the reciprocal motion portion.

On the other hand, when the deformed portion 12 of the diaphragm 4 is pushed by the arm portion 26*b* to the side of the bottom wall 8 of the valve holder 9, the deformed portion 12 is compressed, the capacity of the pump chamber 23 decreases, the discharge valve 38 opens, as shown in FIG. 2, and the air in the pump chamber 23 is discharged into the discharge chamber 36 via the discharge through hole 33. The air discharged into the discharge chamber 36 is discharged to the outside of the pump via the discharge pipe 37.

In the diaphragm pump 1, when the motor 2 makes one rotation, the arm portion 26*b* of the driving mechanism 24 makes one reciprocal motion, and each of a state in which the optical path of the counting sensor 11 is interrupted by the light-shielding plate 28 and a state in which the interruption of the optical path is canceled is implemented once. For this reason, since the number of reciprocal motions of the arm portion 26*b* can be detected by the counting sensor 11, the discharge flow rate of the diaphragm pump 1 can be obtained by calculation.

According to the diaphragm pump 1, the function of detecting the rotation speed need not be imparted to the motor 2, and an inexpensive ready-made motor 2 can be used. Hence, according to this embodiment, it is possible to provide a diaphragm pump capable of detecting the discharge flow rate using an inexpensive ready-made motor 2.

The counting sensor 11 according to this embodiment is an optical sensor that detects a state in which the optical path is interrupted and a state in which the interruption of the optical path is canceled. The arm portion 26*b* of the driving mechanism 24 includes the light-shielding plate 28 that interrupts the optical path in accordance with the reciprocating operation. For this reason, since the number of reciprocal motions of the arm portion 26*b* can correctly be counted, a diaphragm pump that ensured high detection accuracy of the discharge flow rate can be provided.

Note that the counting sensor 11 may be formed using a sensor other than the optical sensor. For example, a magnetic sensor can be used. In this case, a magnet is attached to a plate-shaped member like the light-shielding plate 28, and a magnetic sensor is attached to a position of the counting sensor 11 represented by reference numeral 41.

What is claimed is:

1. A diaphragm pump comprising:

a diaphragm including a deformed portion capable of being deformed into a cup shape;

a pump main body configured to close an opening portion of the deformed portion and form a pump chamber in cooperation with the deformed portion;

a driving mechanism including a reciprocal motion portion attached to the deformed portion and an input portion that rotates integrally with a rotating shaft of a motor, in which a rotation of the input portion is converted into a reciprocal motion in an axial direction of the rotating shaft, and the reciprocal motion portion reciprocally moves;

a pump mechanism configured to suck a fluid into the pump chamber when a capacity of the pump chamber increases, and discharges the fluid in the pump chamber when the capacity of the pump chamber decreases; and a sensor configured to use the reciprocal motion portion as a detection target and alternately switch between a detection state and a non-detection state as the reciprocal motion portion makes a reciprocal motion.

2. The pump according to claim 1, wherein the sensor includes an optical sensor configured to detect a state in which an optical path is interrupted and a state in which the interruption of the optical path is canceled, and the reciprocal motion portion includes a light-shielding portion configured to interrupt the optical path in accordance with a reciprocating operation.

3. The pump according to claim 2, wherein the optical sensor is arranged at a position overlapping the light-shielding portion when the reciprocal motion portion reaches one end of the reciprocal motion.

4. The pump according to claim 1, wherein the driving mechanism further includes a shaft portion rotatably supported by the input portion via a support shaft, the reciprocal motion portion comprises an arm portion projecting outward in a radial direction from the shaft portion, and the arm portion includes a plate-shaped member projecting in a direction opposite to the shaft portion.

5. A diaphragm pump comprising:

a diaphragm including a deformed portion capable of being deformed into a cup shape;

a pump main body configured to close an opening portion of the deformed portion and form a pump chamber in cooperation with the deformed portion;

a crank configured to rotate integrally with a rotating shaft of a motor;

an arm attached to the deformed portion and reciprocally moved in an axial direction of the rotating shaft in accordance with a rotation of the crank;

a suction through hole formed in the pump main body and configured to suck a fluid into the pump chamber as a capacity of the pump chamber increases;

a discharge through hole formed in the pump main body and configured to discharge the fluid in the pump chamber as the capacity of the pump chamber decreases; and a sensor configured to use the arm as a detection target and alternately switch between a detection state and a non-detection state as the arm makes a reciprocal motion.

6. The pump according to claim 5, wherein the sensor includes an optical sensor configured to detect a state in which an optical path is interrupted and a state in which the interruption of the optical path is canceled, and the arm includes a light-shielding plate configured to interrupt the optical path in accordance with a reciprocating operation.

7. The pump according to claim 6, wherein the optical sensor is arranged at a position overlapping the light-shielding plate when the arm reaches one end of the reciprocal motion.

8. The pump according to claim 5, further comprising a base rotatably supported by the crank via a support shaft, wherein the arm is formed to project outward in a radial direction from the base, and the arm includes a plate projecting in a direction opposite to the base.

* * * * *